US006536460B1

(12) United States Patent
Yelverton et al.

(10) Patent No.: US 6,536,460 B1
(45) Date of Patent: Mar. 25, 2003

(54) PROCESS LINE PURGE SYSTEM AND METHOD

(75) Inventors: Mark E. Yelverton, Austin, TX (US); Mark A. Campbell, Austin, TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 08/822,216

(22) Filed: Mar. 21, 1997

(51) Int. Cl.[7] ..... B08B 3/02; B08B 5/04; B08B 9/035

(52) U.S. Cl. ..... 137/240; 134/21; 134/22.11; 134/94.1; 134/95.1; 134/99.1; 134/166 C; 134/169 C; 134/171; 134/902; 137/15.04

(58) Field of Search ..... 137/240, 312, 137/15.04, 15.05; 141/85, 98; 134/166 R, 166 C, 169 R, 169 C, 21, 22.11, 22.12, 22.18, 94.1, 95.1, 98.1, 99.1, 171, 1.3, 902; 222/148; 437/225, 949

(56) References Cited

U.S. PATENT DOCUMENTS 4,064,898 A * 12/1977 Petersen ..... 137/240
4,169,486 A * 10/1979 Otteman et al. ..... 137/240
4,383,547 A * 5/1983 Lorenz et al. ..... 137/240
4,554,942 A * 11/1985 Williams et al. ..... 137/240
4,640,221 A * 2/1987 Barbee et al. ..... 118/689
4,699,805 A * 10/1987 Seelbach et al. ..... 437/245
4,869,301 A * 9/1989 Ohmi et al. ..... 137/240
4,892,615 A * 1/1990 Motta ..... 156/643
4,910,042 A * 3/1990 Hokynar ..... 427/38
4,917,136 A * 4/1990 Ohmi et al. ..... 137/240
5,069,244 A * 12/1991 Miyazaki et al. ..... 137/240
5,137,047 A * 8/1992 George ..... 137/240
5,368,062 A * 11/1994 Okumura et al. ..... 137/240
5,660,201 A * 8/1997 Turner ..... 137/240
5,727,589 A * 3/1998 Yokogi ..... 137/240
5,749,389 A * 5/1998 Ritrosi et al. ..... 137/240

OTHER PUBLICATIONS

Publication entitled, "Scott Semiconductor Gases," Fab 15 Module MG/Eng, Feb. 27, 1997.

* cited by examiner

*Primary Examiner*—George L. Walton
(74) *Attorney, Agent, or Firm*—Robert C. Kowert; Meyertons, Hood, Kivlin, Kowert & Goetzel, P.C.

(57) ABSTRACT

Method and system for purging a process line of a process gas used in a semiconductor wafer fabrication process. Inert gas (e.g., nitrogen gas) is repeatedly charged from an inert gas source into the process line and evacuated using a vacuum system. The vacuum system is preferably supplied with inert gas having a pressure in excess of 30 psig from the inert gas source. The inert gas is introduced into the process line from an inert gas conduit at a predetermined pressure to prevent process gas from liquefying in the process line. A set pressure regulator or an absolute pressure regulator may be used to reduce he pressure of the inert gas to below the vapor pressure of the process gas.

30 Claims, 2 Drawing Sheets

PROCESS LINE PURGE SYSTEM AND METHOD

BACKGROUND OF THE INVENTION

1. Field of the Invention

The present invention generally relates to purging process lines that contain process gases used in semiconductor wafer fabrication, and more particularly to purging process gas having a relatively low vapor pressure from a process line by charging inert gas into the process line and evacuating the process line without liquefying the process gas.

2. Description of the Related Art

In some semiconductor chip fabrication processes (e.g., chemical vapor deposition, physical vapor deposition, etching), it is required that selected gas delivery process lines be maintained free of air. Such process lines are periodically purged to eliminate contaminants (e.g., atmosphere) from the line. Process lines usually must be purged when the flow of process gas through the line ceases, such as when an exhausted process gas source is replaced. Purging a process line typically includes repeatedly charging the line with inert gas and evacuating the line with a vacuum system.

The process gases used in many semiconductor chip fabrication processes frequently have relatively low vapor pressures. If inert purge gas is introduced into a process line at a pressure greater than the vapor pressure of the process gas, the process gas tends to liquefy in the line. The purging of liquefied process gas from a process line is often difficult or impossible. Liquid contained in the process line may also inhibit the functioning of mass flow controllers contained in the line. In addition, many process fluids are especially corrosive in a liquid state, and the presence of such liquids may require the replacement of one or more process lines. Attempts have been made to prevent the formation of liquids in process lines by externally heating the lines when purge gas is introduced into the lines. Such methods, however, tend to be expensive and generally do not prevent process gas from liquefying when the pressure of the purge gas significantly exceeds the vapor pressure of the process gas.

It is therefore desirable that an improved purge system and method be derived to prevent the formation of liquids when inert gas is introduced into process lines during purging.

SUMMARY OF THE INVENTION

In accordance with the present invention, an inert gas purge system and method is provided that largely eliminates or reduces the aforementioned disadvantages of prior methods. An embodiment of the invention relates to a purge system that includes a process conduit for directing a process gas from a process gas source to a process unit. The process conduit preferably communicates with a purge conduit that is connected to an inert gas source. Inert gas is preferably directed from the inert gas source through the purge conduit and into the process conduit. The purge conduit preferably contains a pressure restriction device for reducing the pressure of the inert gas below a predetermined pressure prior to the introduction of the inert gas into the process conduit. The purge system preferably further includes a vacuum system for evacuating the process conduit of inert gas and residual process gas. The vacuum system may include an ejector and a vacuum conduit communicating with the process conduit. The process conduit may be repeatedly charged with inert gas and evacuated until the concentration of process gas within the process conduit falls below a predetermined level.

The pressure reduction device preferably reduces the pressure of the inert gas below the vapor pressure of the process gas to ensure that the pressure within the process conduit remains below the vapor pressure of the process gas. The inert gas is preferably introduced into the process conduit at a predetermined pressure such that substantially no residual process gas liquefies within the process conduit. The process gas may include dichlorosilane, trichlorosilane, tungsten hexafluoride, boron trichloride, carbon tetrachloride, hydrogen fluoride, and/or octafluorocyclobutane. The inert purge gas is preferably nitrogen.

The pressure reduction device is preferably a set (i.e., non-adjustable) pressure regulator. The pressure reduction device may reduce the inert gas pressure from a pressure in excess of about 30 psig to a pressure of about 5 psig or less. The pressure reduction device preferably reduces the pressure of the inert gas to between about 1 psig and about 15 psig prior to its introduction into the process conduit.

The purge system is preferably included in a gas tray system and/or gas panel system used to deliver process gas to a process unit. The process unit may be a chemical deposition chamber, physical vapor deposition chamber, etching chamber, or other unit that uses process gas in a semiconductor wafer manufacturing process.

An advantage of the invention relates to charging an inert purge gas into a process conduit without liquefying residual process gas contained in the process conduit.

BRIEF DESCRIPTION OF THE DRAWINGS

Further advantages of the present invention will become apparent to those skilled in the art with the benefit of the following detailed description of the preferred embodiments and upon reference to the accompanying drawings in which.

Figure 1:
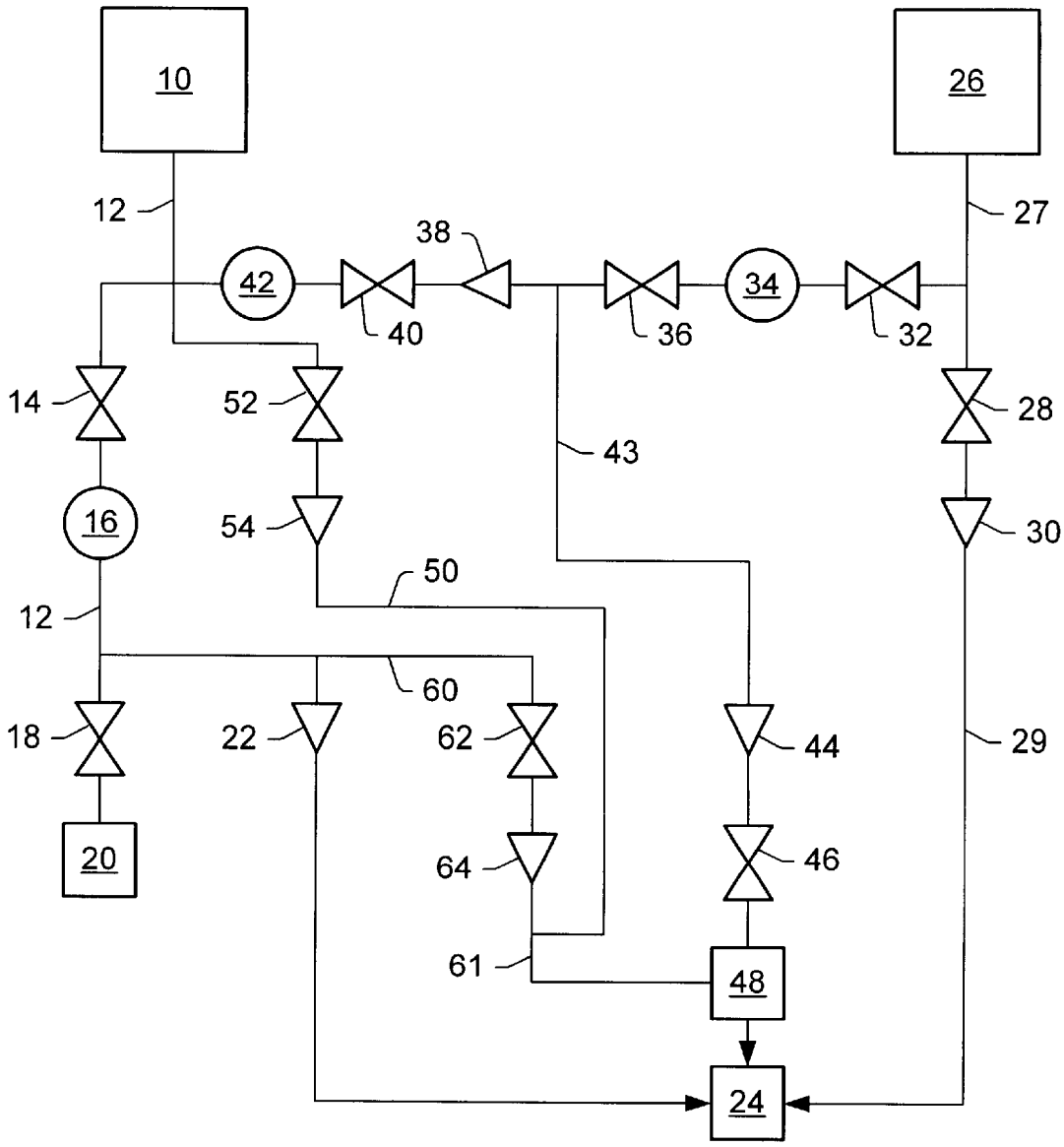
FIG. 1 is a schematic diagram depicting a gas panel system including a purge system in accordance with the invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

A gas panel system is schematically shown in FIG. 1. The gas panel system includes a source of process gas 10 for introducing process gas into process conduit 12. The process conduit 12 preferably extends from process gas source 10 to process unit 20. The process gas may include dichlorosilane, trichlorosilane, tungsten hexafluoride, boron trichloride, octafluorocyclobutane, carbon tetrachloride, hydrogen fluoride or any other gas for use in a semiconductor wafer fabrication process. The process gas is typically introduced from source 10 into conduit 12 at a pressure in the vicinity of the vapor pressure of the process gas. Process conduit 12 may contain a pressure that is less than atmospheric pressure while process gas is directed to process unit 20. Valves 14 and 18 are preferably opened to permit the process gas to proceed through the process conduit to process unit 20. Pressure regulator 16 is preferably used to reduce the pressure of the process gas to a selected pressure before the process gas is directed to process unit 20. The gas panel may include a pressure relief valve 22 for releasing pressure build-up in the system. In one embodiment, the pressure relief valve opens to release gas to vent 24 when the pressure upstream of valve 22 exceeds 100 psig.

Process gas source 10 may be a gas bottle or container that must be replaced when it becomes exhausted of process gas or when it is desired to alter the type or concentration of process gas directed to process unit 20. The replacement of process gas source 10 will tend to allow at least a slight amount of atmospheric air to enter into process conduit 12. The process conduit may be purged of such air and residual process gas by repeatedly (a) charging an inert gas into the process conduit and (b) evacuating the gas from the process conduit.

Inert gas source 26 communicates with purge conduit 27 to allow inert purge gas to be introduced into the system. As described herein, two or more conduits or sources are said to "communicate" when fluid may be transferred between them. Communicating conduits may be connected together directly or indirectly (i.e., through other conduits). The purge gas is preferably nitrogen gas, although other inert gases may be used as will be recognized by those skilled in the art. Purge conduit 27 is preferably connected to process conduit 12 to allow inert gas to be charged into the process conduit. Valves 32 and 36 may be opened to permit the purge gas to proceed through pressure regulator 34, which preferably reduces the pressure of the purge gas to between about 30 psig and 50 psig, and more preferably to about 40 psig.

Purge conduit 27 may communicate with bleed conduit 29 for bleeding inert gas from inert gas source 26 to vent 24. Bleed conduit 29 may contain a valve 28 for blocking the flow of inert gas to the vent, and may contain check valve 30 for preventing the backflow of gas in a direction from vent 24 to purge conduit 27.

The gas panel system preferably includes an ejector 48 for creating a vacuum to evacuate process conduit 12. Ejector 48 is preferably configured to receive inert gas from conduit 43. The ejector may contain a nozzle and a venturi-shaped diffuser through which the inert gas or another suitable gas (e.g., steam) is passed at high velocity to create a vacuum in vacuum conduit 61. The use of such an ejector is well known to those skilled in the art. It is to be understood that a vacuum pump or other vacuum system may be used in place of ejector 48 in an alternate embodiment.

The process gas delivered from source 10 may have a relatively low vapor pressure. For instance, the vapor pressures (at 70° F.) of the process gases dichlorosilane, trichlorosilane, tungsten hexafluoride, boron trichloride, octafluorocyclobutane, carbon tetrachloride, and hydrogen fluoride are 23.7 psia, 25 psia, 17.3 psia, 19.3 psia, 39.7 psia, 1.6 psia, and 15 psia, respectively. If process gas liquefies in process conduit 12, evacuating the process conduit can become difficult or impossible. The liquefied process gas may induce corrosion in the process conduit, making replacement of the conduit necessary.

The inert gas delivered from inert gas source 26 preferably has a pressure immediately downstream of regulator 34 that is generally much greater (e.g., 5 to 100 psi greater) than the pressure of the process gas within process conduit 12. In this manner, the backflow of process gas into the purge system can be minimized. Regulator 34 may be set to cause the inert gas pressure to be greater than about 100 psig when a portion of the inert gas is delivered to ejector 48 to allow evacuation of the process conduit. In an embodiment of the invention, a pressure reduction device 42 is disposed within purge conduit 27 to reduce the pressure of the inert gas below a predetermined pressure prior to its introduction into process conduit 12. The predetermined pressure is preferably such: that the introduction of the inert gas into the process conduit does not result in liquefication of any process gas. The pressure of the inert gas is preferably reduced to a pressure below the vapor pressure of the process gas in conduit 12. A valve (not shown) may be placed immediately downstream of pressure reduction device 42 to prevent process gas from flowing through device 42 in a direction toward check valve 38.

In one embodiment, the process gas is dichlorosilane or trichlorosilane, and the pressure reduction device 42 is configured to reduce the pressure of the inert gas to between about 3 psig and about 9 psig, more preferably to between about 4 psig and about 7 psig, and more preferably still to about 5 psig. In another embodiment, the process gas is tungsten hexafluoride or boron trichloride, and the pressure reduction device 42 is configured to reduce the pressure of the inert gas to between about 1 psig and about 2.5 psig, and more preferably to about 2 psig. In another embodiment, the process gas is octafluorocyclobutane, and the pressure reduction device is configured to reduce the pressure of the inert gas to between about 5 psig and about 15 psig, and more preferably to about 10 psig. In yet another embodiment, the process gas is hydrogen fluoride, and the pressure reduction device 42 is configured to reduce the pressure of the inert gas to between about 10 psia and about 15 psia, and more preferably about 14.7 psia.

Pressure reduction device 42 is preferably a set or "non-adjustable" pressure regulator. Pressure reduction device 42 preferably reduces the pressure of the purge gas to a predetermined pressure regardless of the pressure of the purge gas upstream of device 42. It is to be understood however, that pressure reduction device 42 may instead be a control valve or any other fluid restriction device adapted to reduce the pressure of the inert gas below the vapor pressure of the process gas. It is generally preferred that a set pressure regulator be used to substantially eliminate the possibility that the pressure reduction device will be inadvertently adjusted such that the inert gas is delivered to process conduit 12 at a pressure above the vapor pressure of the process gas. The SR4 series set pressure regulator has been found to perform adequately as a pressure reduction device and is commercially available from Integrated Flow Systems, Inc. located in Santa Cruz, Calif.

It may be desired to introduce the purge gas into process conduit 12 at a pressure below atmospheric pressure when the process conduit contains a process gas (e.g., carbon tetrachloride, hydrogen fluoride) that has a vapor pressure in the vicinity of atmospheric pressure or less. In such an embodiment, pressure reduction device 42 maybe an absolute pressure regulator that provides a predetermined pressure drop in the purge gas as it passes through device 42. The absolute pressure or "diaphragm-type" regulator allows the pressure of the purge gas to be reduced to less than atmospheric pressure (and preferably less thank the vapor pressure of the process gas) prior to the introduction of the purge gas into the process conduit. In this manner, liquefication of process gas in the process conduit can be greatly reduced or eliminated. The use of absolute pressure regulators is well known to those skilled in the art.

The process conduit 12 is preferably evacuated before purge gas is introduced into the process conduit from inert gas source 26. Prior to evacuating process conduit 12, process gas source 10 may be blocked off from communication with conduit 12, and valves 18 and 40 are preferably closed. Valve 62 may be opened to evacuate the process conduit whereby the process gas within the process conduit passes through conduit 60 and ejector 48 into vent 24.

After the process conduit has been evacuated, purge gas may be charged into the process conduit to reduce the concentration of residual process gas therein. With valves 28, 52, and 62 closed, valves 32, 36, and 40 are preferably opened to allow inert gas to pass into process conduit 12. The pressure of the inert gas is preferably at least about 30 psig (more preferably at least about 100 psig) as the inert gas exits regulator 34, and valve 46 may be opened to allow the inert gas to pass through ejector 48, thereby creating a vacuum suction in, vacuum conduits 50 and 60. Valve 14 is preferably opened to allow the inert gas to pass through regulator 16 and into vacuum conduit 60. After the process conduit is charged with a predetermined amount of inert gas, valve 40 is preferably closed and valve 62 may be opened to evacuate the process conduit by allowing the gas within conduits 12 and 60 to pass through ejector 48 and into vent 24. Check valves 64, 44, and 54 serve to prevent the backflow of gas from vent 24. During evacuation-of-the process conduit, ejector 48 may be operated to create a pressure within process conduit 12. That is between a vacuum of about 20 inches of water and a vacuum of about 40 inches of water, and more preferably a vacuum of about 30 inches of water. After evacuation, valve 62 is preferably closed and inert gas is charged into conduit 12 in the above-described manner before valve 62 is reopened to evacuate conduit 12. This procedure may be repeated until the process conduit is substantially free of process gas and any contaminants.

In an alternate embodiment, vacuum conduit 50 may be used to allow evacuation of a portion of conduit 12 without passing purge gas through regulator 16. The above-described procedure may be followed with the exception that valve 14 remains closed to prevent the flow of inert gas through regulator 16, and valve 52 is opened to allow the portion of process conduit 12 in the vicinity of process gas source 10 to be evacuated through vacuum conduit 50.

Figure 2:
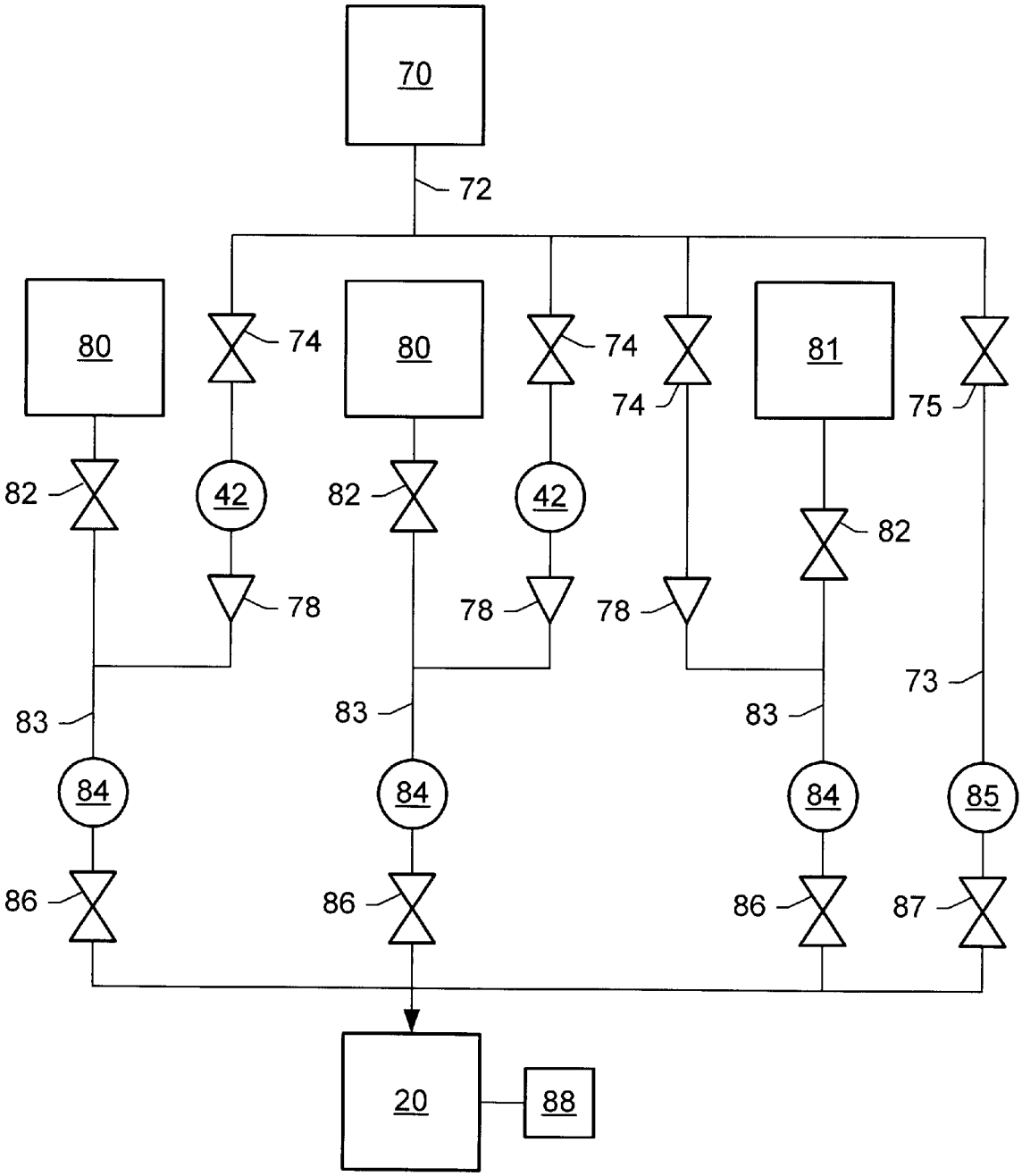
FIG. 2 is a schematic diagram depicting a gas tray system including a purge system in accordance with the invention.

A gas tray system is schematically shown in FIG. 2. The gas tray system preferably contains one or more process gas sources 80 and 81 for introducing process gas into a process unit 20. Three process gas sources are shown in the gas tray system of FIG. 2 for convenience. Process gas sources 80 and 81 may each represent a section of a process conduit such as process conduit 12 (shown in FIG. 1) at a location downstream of valve 18. In the system shown in FIG. 2, process gas sources 80 each contain a process gas having a relatively low vapor pressure (e.g., less than about 40 psia). Process gas source 81 contains a process gas having a moderate to relatively high vapor pressure. The process gas from source 81 may be under a pressure between about 25 psig and about 50 psig. The pressure of the purge gas introduced into purge conduit 72 from inert gas source 70 is preferably (a) greater than the pressure of the process gas from source 81 and (b) between about 30 psig and about 60 psig.

Valves 82 and 86 are preferably opened to allow process gas to be supplied to process unit 20 from process conduit 83. Mass flow controller 84 preferably regulates the amount of process gas supplied to process unit 20. The use of mass flow controllers is well known to those skilled in the art.

The gas tray system depicted in FIG. 2 includes an inert gas conduit 73 having mass flow controller 85 disposed therein for supplying purge gas into process unit 20. The process unit may contain a reactor that requires the inert gas from source 70. In an embodiment, process unit 20 is a chemical vapor deposition chamber and valves 75 and 87 are opened to supply an inert gas such as nitrogen into the chamber to "backfill" the chamber, thereby raising the pressure within the chamber from below 0 psig to atmospheric pressure or greater.

The gas tray system preferably includes inert gas source 70 for charging process conduit 83 with inert gas during purging of the process conduit. Valve 82 is preferably closed and valves 74 and 86 may be opened to allow inert gas to be supplied from purge conduit 72, through pressure reduction device 42, and into process conduit 83. Pressure reduction device 42 preferably reduces the pressure of the inert gas below the vapor pressure of the process gas contained within process conduit 83 to prevent residual process gas from liquefying in conduit 83. Check valve 78 may be used to minimize the backflow of process gas into inert gas source 70. In an embodiment, inert gas source 70 and inert gas source 26 are common.

Process unit 20 may be any process unit using process gas supplied from a gas panel system and may include a chemical vapor deposition chamber, a physical vapor deposition chamber, an ion implanter chamber, a dry etch chamber, and/or a vapor etch chamber. Process conduit 83 may be evacuated by an ejector or vacuum system 88 that communicates with process unit 20 as shown in FIG. 2. Alternately, the vacuum system may directly communicate with process conduit 83 to allow the process conduit to be evacuated without evacuating any portion of process unit 20. The pressure within the process conduit may be maintained below atmospheric pressure while the process gas is directed to process unit 20.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A purge system, comprising:

a process conduit containing a process gas having a vapor pressure;

a process gas source connected to the process conduit for supplying the process gas into the process conduit;

a purge conduit communicating with the process conduit;

an inert gas source comprising inert gas, the inert gas source being adapted to supply inert gas through the purge conduit into the process conduit;

a pressure reduction device disposed within the purge conduit, the pressure induction device being adapted to reduce a pressure of the inert gas prior to introduction of the inert gas into the process conduit such that a pressure within the process conduit is maintained below the vapor pressure of the process gas; and a vacuum system for evacuating the process conduit, the vacuum system comprising a vacuum conduit communicating with the process conduit.

2. The system of claim 1 wherein the process gas is selected from the group consisting of dichlorosilane, trichlorosilane, tungsten hexafluoride, boron trichloride, octafluorocyclobutane, carbon tetrachloride, and hydrogen fluoride.

3. The system of claim 1 wherein the pressure reduction device reduces the pressure of the inert gas from a first pressure in excess of about 30 psig to a second pressure less than about 10 psig.

4. The system of claim 1 wherein the process gas comprises tungsten hexafluoride and wherein the pressure reduction device is a set pressure regulator that reduces the pressure of the process gas to between about 1 psig and about 2.5 psig.

5. The system of claim 1 wherein the inert gas comprises nitrogen.

6. The system of claim 1 wherein the pressure reduction device is a set pressure regulator.

7. The system of claim 1 wherein the pressure reduction device reduces the pressure of the inert gas to between about 5 psig and about 15 psig.

8. The system of claim 1 wherein the pressure reduction device reduces the pressure of the inert gas to between about 3 psig and about 9 psig.

9. The system of claim 1 wherein the pressure reduction device reduces the pressure of the inert gas to between about 1 psig and about 2.5 psig.

10. The system of claim 1 wherein the vacuum system comprises an ejector, and wherein the purge conduit communicates with the vacuum system to supply a portion of the inert gas to the ejector.

11. The system of claim 1, further comprising a chemical vapor deposition chamber connected to the process conduit to receive the process gas.

12. The system of claim 1, further comprising a mass flow controller disposed within the process conduit to regulate a flow of process gas through the process conduit.

13. The system of claim 1 wherein the pressure reduction device is an absolute pressure regulator adapted to reduce the pressure of the inert gas below atmospheric pressure.

14. The system of claim 1 wherein the process conduit communicates with a process chamber, and wherein a communication path between the vacuum conduit and the process conduit does not include the process chamber.

15. The system of claim 1, wherein the pressure reduction device is adapted to reduce the pressure of the inert gas below the vapor pressure of the process gas to prevent the process gas from liquefying.

16. The system of claim 1, wherein the vacuum system is adapted to evacuate the process conduit to remove the inert gas and residual process gas subsequent to removing the process gas from the process conduit.

17. A method for purging a process conduit containing process gas, comprising:

supplying inert gas from an inert gas source into a purge conduit, the inert gas being at a pressure greater than a vapor pressure of the process gas;

introducing the inert gas from the purge conduit into the process conduit;

prior to introducing the inert gas, passing the inert gas through a pressure reduction device disposed in the purge conduit to reduce the pressure of the inert gas below a predetermined pressure such that a pressure within the process conduit is maintained below the vapor pressure of the process gas; and evacuating the process conduit.

18. The method of claim 17, comprising disconnecting a first process gas source from the process conduit and connecting a second process gas source to the process conduit prior to supplying the inert gas source into the purge conduit.

19. The method of claim 17 wherein the predetermined pressure is no greater than the vapor pressure of the process gas.

20. The method of claim 17 wherein the pressure reduction device is a set pressure regulator.

21. The method of claim 17 wherein the process gas is selected from the group consisting of-dichlorosilane, trichlorosilane, tungsten hexafluoride, boron trichloride, octafluorocyclobutane, hydrogen fluoride, and carbon tetrachloride.

22. The method of claim 17, further comprising passing a portion of the inert gas from the purge conduit to an ejector for evacuating the process conduit.

23. The method of claim 17 wherein the process conduit contains a pressure less than atmospheric pressure prior to the step of introducing the inert gas into the process conduit.

24. The method of claim 17 wherein the process gas comprises dichlorosilane, and wherein the predetermined pressure is between about 4 psig and about 7 psig.

25. The method of claim 17 wherein the pressure reduction device is an absolute pressure regulator.

26. The method of claim 17 wherein the process gas comprises hydrogen fluoride, and wherein the predetermined pressure is less than atmospheric pressure.

27. The method of claim 17 wherein the pressure reduction device is an absolute pressure regulator, and wherein the predetermined pressure is less than atmospheric pressure.

28. The method of claim 17 wherein a process chamber communicating with the process conduit is maintained below atmospheric pressure during said introducing and said evacuating.

29. The method of claim 17, wherein said passing the inert gas through a pressure reduction device allows substantially no process gas to liquefy in the process conduit after the inert gas is introduced into the process conduit.

30. The method of claim 17, wherein said evacuating comprises evacuating the process conduit of the inert gas and residual process gas subsequent to removing the process gas from the process conduit.

* * * * *